United States Patent [19]

Carson et al.

[11] Patent Number: 5,057,979

[45] Date of Patent: Oct. 15, 1991

[54] RECESSED LIGHTING FIXTURE

[75] Inventors: Douglas W. Carson, Downey; Raymond J. Kusmar, LaHabra, both of Calif.

[73] Assignee: Thomas Industries, Inc., Los Angeles, Calif.

[21] Appl. No.: 448,951

[22] Filed: Dec. 12, 1989

[51] Int. Cl.[5] ..... F21V 21/04

[52] U.S. Cl. ..... 362/147; 362/365

[58] Field of Search ..... 362/147, 148, 364, 365, 362/404, 74

[56] References Cited

U.S. PATENT DOCUMENTS

| | | | |
|---|---|---|---|
| 2,602,881 | 7/1952 | Pryne | 362/365 |
| 2,741,695 | 4/1956 | Schockett | 362/365 |
| 2,863,990 | 12/1958 | Wince | 362/365 |
| 3,158,329 | 11/1964 | Wince | 362/365 |
| 3,488,626 | 1/1970 | Koerper et al. | 362/365 |
| 3,852,585 | 12/1974 | Brunger | 362/365 |
| 4,118,760 | 10/1978 | Cohon | 362/270 |
| 4,327,403 | 3/1982 | Capostagno et al. | 362/365 |
| 4,336,575 | 6/1982 | Gilman | 362/365 |
| 4,388,677 | 6/1983 | Druffel | 362/365 |
| 4,408,262 | 10/1983 | Kusmer | 362/365 |
| 4,482,940 | 11/1984 | Brandherm | 362/74 |
| 4,684,223 | 9/1987 | Campolo | 362/276 |
| 4,733,336 | 3/1988 | Skogler et al. | 362/74 |
| 4,764,851 | 8/1988 | Hartmann | 362/74 |
| 4,894,759 | 1/1990 | Siems | 362/250 |

FOREIGN PATENT DOCUMENTS

| | | | |
|---|---|---|---|
| 595142 | 3/1960 | Canada | 362/365 |

*Primary Examiner*—Ira S. Lazarus
*Assistant Examiner*—Richard R. Cole
*Attorney, Agent, or Firm*—Hill, Van Santen, Steadman & Simpson

[57] ABSTRACT

A recessed lighting fixture is molded in one piece, preferably of plastic, and includes a frame for holding a lamp housing as well as a junction box having a hinged lid. The frame and junction box define a planar vertical surface which is abutted against a joist and affixed thereto by nails extending through spaced nailways. Hangerways are also provided in the lighting fixture through which hanger bars are inserted for supporting the lighting fixture between two joists as an alternate way of supporting the fixture.

19 Claims, 3 Drawing Sheets

FIG. 1
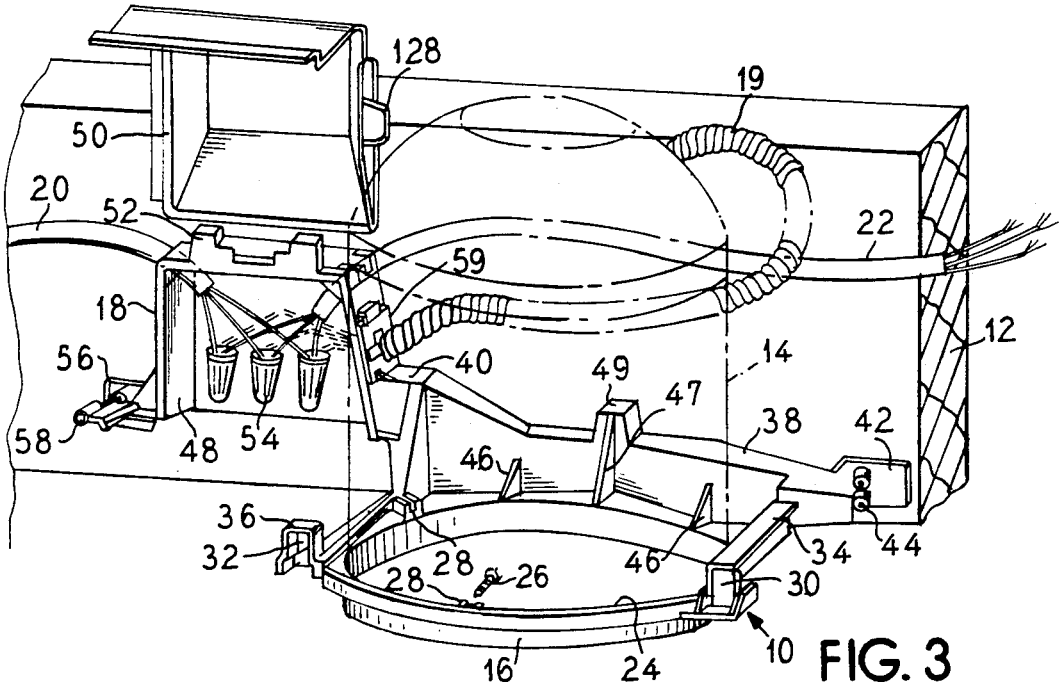
FIG. 3
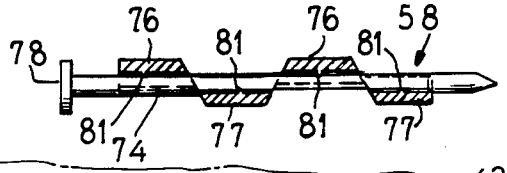
FIG. 2
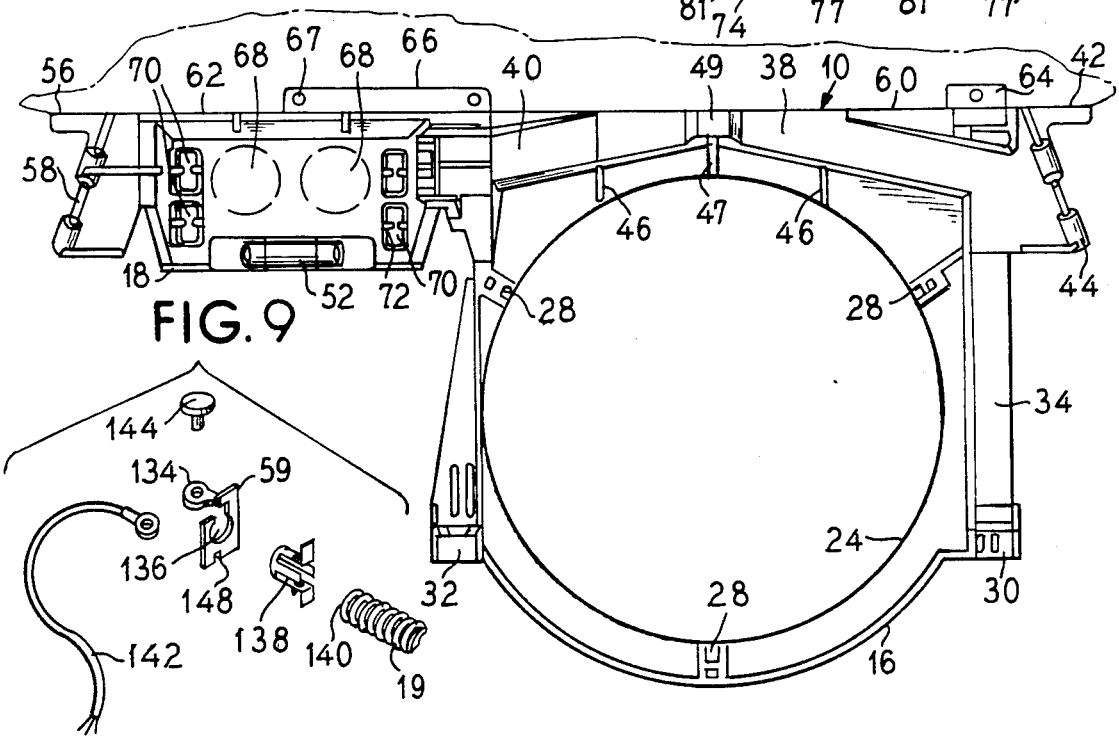
FIG. 9

RECESSED LIGHTING FIXTURE

BACKGROUND OF THE INVENTION

1. Field of the Invention

The present invention relates generally to a recessed light fixture and, more particularly, to a combination plaster frame and junction box for holding a lamp housing in place in a ceiling or the like.

2. Description of the Related Art

Recessed lighting, in which a lighting assembly is mounted in a ceiling or the like so that its light shines through an opening in the ceiling into a room or other area to be lighted, is coming into common use as a creative approach to lighting. An electric lamp, generally mounted in a socket, is held in a lamp housing. The lamp housing, in turn, is secured in position in the ceiling by a fixture or bracket commonly known as a plaster frame. The plaster frame may include hanger bars which extend to and are fastened to and between joists in the ceiling. The weight of the light fixture is thereby supported by the joists through the hanger bars instead of being supported on the ceiling panels or other ceiling material.

An example of a plaster frame is disclosed in U.S. Pat. 4,408,262 in which a rectangular plate having a central aperture is supported by hanger bars extending through hanger bar brackets on the plate. The hanger bars are mounted extending between joists in a ceiling. An electrical junction box is mounted on the plate.

U.S. Pat. 2,741,695 also discloses a recessed lighting fixture including a plaster frame having a supply wire outlet box which is suspended between adjacent joists by hanger bars.

A recessed lighting fixture that is provided with a junction box connected by means of a bracket is disclosed in U.S. Pat. 3,361,904.

SUMMARY OF THE INvENTION

An object of the present invention is to simplify installation of a recessed lighting fixture and to provide an inexpensive and lightweight mount for a lamp holder of a recessed lighting assembly.

Another object of the invention is to reduce the number of parts and the amount of time necessary for installation of a recessed lighting fixture.

A further object of the invention is to support a recessed lighting fixture on ceiling joists or the like without the use of hanger straps or bars.

Yet another object of the invention is to provide a plaster frame for a recessed lighting fixture which may be supported either by hanger bars or by being affixed directly to a joist or the like.

These and other objects and advantages of the invention are achieved in a recessed lighting fixture that is molded in few parts of an inexpensive material. The fixture includes a frame for supporting a lamp holder, or lamp housing, with one side of the frame defining a generally planar joist abutting surface for placement against a side surface of a joist or the like and further including means for fastening the joist abutting surface to the joist or the like. One such fastening means is nailways formed on the frame through which nails are inserted and then driven into the joist to support the recessed lighting fixture on the joist. The frame is, thus, mounted simply by driving nails, which may already be in the nailways, into the adjoining joist.

Although the nails can be inserted into the nailways by the user, it is preferred that the nailways include means for engaging the nails and that the nails be secured in the nailways by the engaging means. The engaging means still permits the nails to slide along the nailways when struck while being driven into the joist, but prevents the nails from falling out of the nailways before the present frame is installed.

To insure proper alignment and positioning of the frame within the ceiling, alignment tabs extend from the frame beyond the joist abutting surface for placement against an edge of the joist before fastening the frame in place. Although such tabs can simply engage the joist edge, it is contemplated that the tabs also have openings through which nails or other fasteners can be inserted for added support and positive alignment.

Another advantage is provided by means for supporting the frame on hanger bars or straps extending between joists so that the lighting fixture can be supported on such hanger bars when desired as an alternate means of support. Such means for supporting the frame on hanger bars preferably includes hangerways, or passageways, formed in the frame through which the hanger bars are inserted during installation and mounting of the frame. In a preferred development, the hangerways are shaped so that the hanger bars, such as two part, telescoping hanger bars, can be inserted through the hangerways during installation and so that the hanger bars can lie either flat in a horizontal plane or on edge in a vertical plane within the hangerways to support the frame.

A junction box is preferably provided affixed to the plaster frame of the present recessed lighting fixture. The junction box provides ease of access during installation, inspection and repair of the wiring to the lighting fixture since it preferably opens both on a side face as well as at a bottom face. Access to the junction box from below after the lighting fixture is mounted in the ceiling is thereby improved. To reduce the number of loose parts which must be dealt with during installation of the present fixture, the junction box preferably includes a hinged lid, or door, which swings between its open position and a closed position enclosing the wiring connections. In a preferred embodiment, the hinge for the junction box is provided at the top thereof, although it is also contemplated to provide the hinge at other locations, including on the side of the junction box.

Ease of inspection and repair of the lighting assembly after the recessed lighting frame and the ceiling panel are in place is achieved when the lid or door of the junction box is accessible through the ceiling opening. The lamp housing is, of course, not in the present frame during the inspection or repair. To enable the door to be opened, a latch for securing the door in a closed position is located on the side of the junction box nearest the opening in the frame which receives the lamp holder and which is in registration with the ceiling opening. An inspector or repair person is then able to easily reach through the ceiling opening and open the junction box. Preferably, the hinge location and door shape permit the wiring within the junction box to be viewed and repaired from through the ceiling opening. A preferred embodiment provides a nailway support means on an opposite side of the junction box from the latch.

To insure good support of the junction box when the device is mounted abutting a joist, the rear surface of the junction box is preferably coplanar with the joist abutting surface of the frame. Neither the joist abutting surface nor the rear surface of the junction box need be continuous, however, since ribs or other shapes may be provided having portions thereof lying in a plane so as to abut a surface. Of course, the joist abutting surface may be configured so that it fits flush against a wall instead of against a joist.

The junction box includes knock-outs through which wiring is passed to be joined inside the box. While it is possible to utilize a wide variety of different knock-outs, the preferred embodiments include rectangular knock-outs on the corners of the box that are adapted to receive non-metallic sheathed cable.

The present lighting fixture is preferably molded of a polymeric or plastic material, generally in one piece. It is also contemplated to cast the lighting fixture of metal, such as zinc. This would only require that the knock-outs be different than in a polymeric material embodiment, all other features generally being the same. In one embodiment, the door of the junction box is a separate part, while it is also possible that the junction box door be joined to the rest of the fixture by a living hinge and, thus, be molded in one piece with the frame.

To simplify mold construction and enable a relatively less expensive pull-apart mold to be used, an opening is provided in the side wall of the junction box which accepts an insert having a fastening means for a wiring conduit that extends to the lamp housing. The insert has an opening of a predetermined size that accepts a fastening clip on the end of the conduit. When the insert is formed of an electrically conductive metal, it also provides a ground connection location for ground leads even when the rest of the recessed lighting frame is of a molded plastic.

While the preferred fixture is adapted for mounting abutting a joist, it is also contemplated to provide a molded polymeric fixture and junction box mountable solely by hanger straps, thus not requiring a planar joist abutting surface. Should such a hanger supported embodiment be provided, the various elements need not be arranged in the same positions as in a joist supported embodiment.

The fixture of the invention is, thus, simple to make and simple to install, in addition to being inexpensive, lightweight and versatile.

BRIEF DESCRIPTION OF THE DRAWINGS

FIG. 1 is a perspective view of a recessed lighting fixture according to the principles of the present invention mounted on a ceiling joist and showing a lamp housing in phantom;

FIG. 2 is a plan view of the recessed lighting fixture of FIG. 1;

FIG. 3 is a cross section along line III—III of FIG. 2 showing a nailway of the recessed lighting fixture of the invention;

FIG. 9 is an exploded view of the conduit connection and ground plate assembly for mounting in the side of the junction box.

DESCRIPTION OF THE PREFERRED EMBODIMENTS

Figure 5:
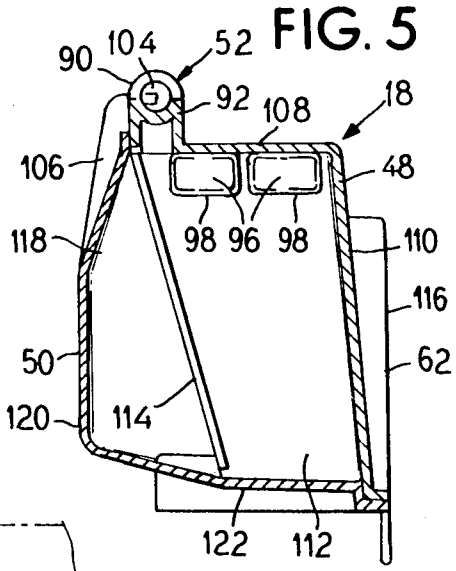
FIG. 5 is a cross section along line V—V of FIG. 2 through the junction box portion of the present recessed lighting fixture.

In FIG. 1 is shown a recessed lighting fixture 10 according to the present invention supported on a joist 12 and holding a lamp housing 14. The recessed lighting fixture 10 is molded of polymeric material and includes as its major constituent parts a frame portion 16 and a junction box portion 18. The lamp housing 14 is held in the frame portion 16, while power is supplied to the electric lamp in the lamp housing 14 from the junction box 18 through a wiring raceway, or conduit, 19. Electrical power is supplied to the junction box 18 and to other sequentially connected lighting fixtures (not shown) through cables 20 and 22 connected into the junction box 18.

The frame 16 of the illustrated embodiment outlines a circular opening 24 into which the lamp housing 14 is fastened, such as by screws 26 inserted into screw channels 28 in the frame 16. On opposite sides of the frame 16 are provided a pair of hangerways 30 and 32 through which hanger bars (not shown) may be inserted when mounting the fixture 10 by hanger bars. The hangerway 30 has a lateral flange 34 over the hangerway, while the second hangerway 32 is open to the top except for a short bridge 36. Across the rear of the frame 16, a vertical support flange 38 abuts the joist 12 and provides a connecting link to the junction box 18 at 40. The end of the vertical flange 38 opposite the link 40 is provided with a hold tab 42 and a nailway 44 as a support means. Various strengthening ribs 46 are provided on the fixture to ensure stability of the lamp housing 14. A central rib 47 extends to a tower 49 which is provided in a preferred embodiment for added support of the lamp housing 14.

As can be seen, the junction box 18 includes a first, stationary portion 48 to which a door 50 is connected by a hinge 52. The door 50 is shown in an open position to thereby provide access to wiring connections 54 found therein. When the door 50 is open, the wiring connections 54 are accessible from the front as well as from below so that the wiring can be installed and maintained easily after the lighting fixture 10 is mounted in position in the ceiling. The wiring connections 54 are also accessible from through the circular opening 24 in the frame 16 when the door 50 is open for inspection and repair.

The recessed lighting fixture 10 shown in FIG. 1 includes a second hold tab 56 and a second nailway 58 at the side of the junction box 18 opposite the link 40. The fixture 10 is, thus, mounted abutting the joist 12 and is held in place by nails passing through the nailways 44 and 58 at opposite ends of the lighting fixture 10.

Visible behind the lamp housing 14 (shown in phantom in FIG. I) is a connector means 59 which secures one end of the conduit 19 into the side of the junction box 18. As will be described in more detail hereinafter, the connector means 59 is formed of a metal plate having an opening into which the conduit is fastened. The metal plate, in turn, is secured over an opening in the side of the molded junction. The metal connector means 59 can be formed more easily and inexpensively to receive in secure engagement a fitting for the conduit 19 than is possible to mold using an inexpensive pull-apart mold without slides. In addition, the metal connector 59 provides a grounding plate to which the various ground leads may be connected, since the frame 16 and junction box 18 are preferably of a plastic material.

The lighting fixture 10 is shown in a plan view in FIG. 2 including the frame 16 forming the circular opening 24 into which the lamp housing 14 is mounted. The lamp housing in the illustrated embodiment is held in place by three of the screws 26 which are received into the screw channels 28 that are equally spaced about the circular opening 24. On either side of the frame 16 is formed the hangerways 30 and 32 through which hanger bars (not shown) may, when desired as an alternate mounting means, be inserted. The vertical flange 38 forms a planar abutting surface 60 which is placed against the joist 12 when mounted as shown in FIG. 1. A rear surface 62 of the junction box 18 is coplanar with the abutting surface 60 so that the junction box also rests against the joist 12.

A pair of alignment tabs 64 and 66 extend beyond the plane of the planer surface 60 and are used to align the fixture 10 to a bottom edge of the abutting joist 12. Although the alignment tabs can be of any size and width so long as they extend into the plane of the joist abutting surface 60 far enough to engage the joist 12, the illustrated alignment tabs 64 and 66 are large enough to include fastener openings 67. In particular, the alignment tab 64 has one fastener opening 67 and the alignment tab 66 has two fastening openings 67 that are spaced apart from one another. The fastener openings 67 permit nails or other fasteners to be inserted therethrough for positive positioning and alignment of the fixture relative to the joist 12. Fasteners in the fastener openings 67 of the alignment tabs 64 and 66 also provide support for the fixture 10. Of course, a continuous tab along the joist abutting surface, or multiple projections even of other shapes, can be used to align the fixture 10 on a joist or other structural member.

As can be seen, the nailways 44 and 58 are directed into the plane of the planer surface 60 and lie at intersecting angles. In the preferred embodiment, the nailways 44 and 58 are at 20° to perpendicular. For added strength, the vertical flange 38 lies at an angle to the planar surface 60, the angle being preferably about 12°. The apex of the angled flange 38 is at the tower 49.

The junction box 18 shown in FIG. 2 includes the hinge 52 at its front edge as well as circular top knock-outs 68 and rectangular corner knock-outs 70 which are removed for installation of the wiring. Each of the corner knock-outs 70 has a thin rectangular periphery and an interrupted ridge 72 across its center. Removal of the corner knock-outs 72 is easily accomplished by placing a screwdriver blade into the notch in the ridge 72 and striking or pressing the screwdriver to break out the knock-outs 72.

FIG. 3 shows a cross section through the nailway 58 in which a central passage, or nailway, 74 is defined by alternating wall portions 76 and 77 on the top and bottom thereof, respectively. A nail 78 is able to slide easily along the nailway passage 74 to be driven into the joist 12. To keep the nail 78 in the nailway 74 and prevent it from slipping out during handling of the fixture 10, ribs 81 are provided extending into the nailway 74 which press against the nail 78. It is contemplated to provide a nail in each nailway of the present fixture 10, the nails being held in place by the ribs 81, so that the correct size and type of nail need not be searched for during the installation process. The nail 78 is able to slide along the nailway 74 when it is struck by a hammer or the like.

Figure 4:
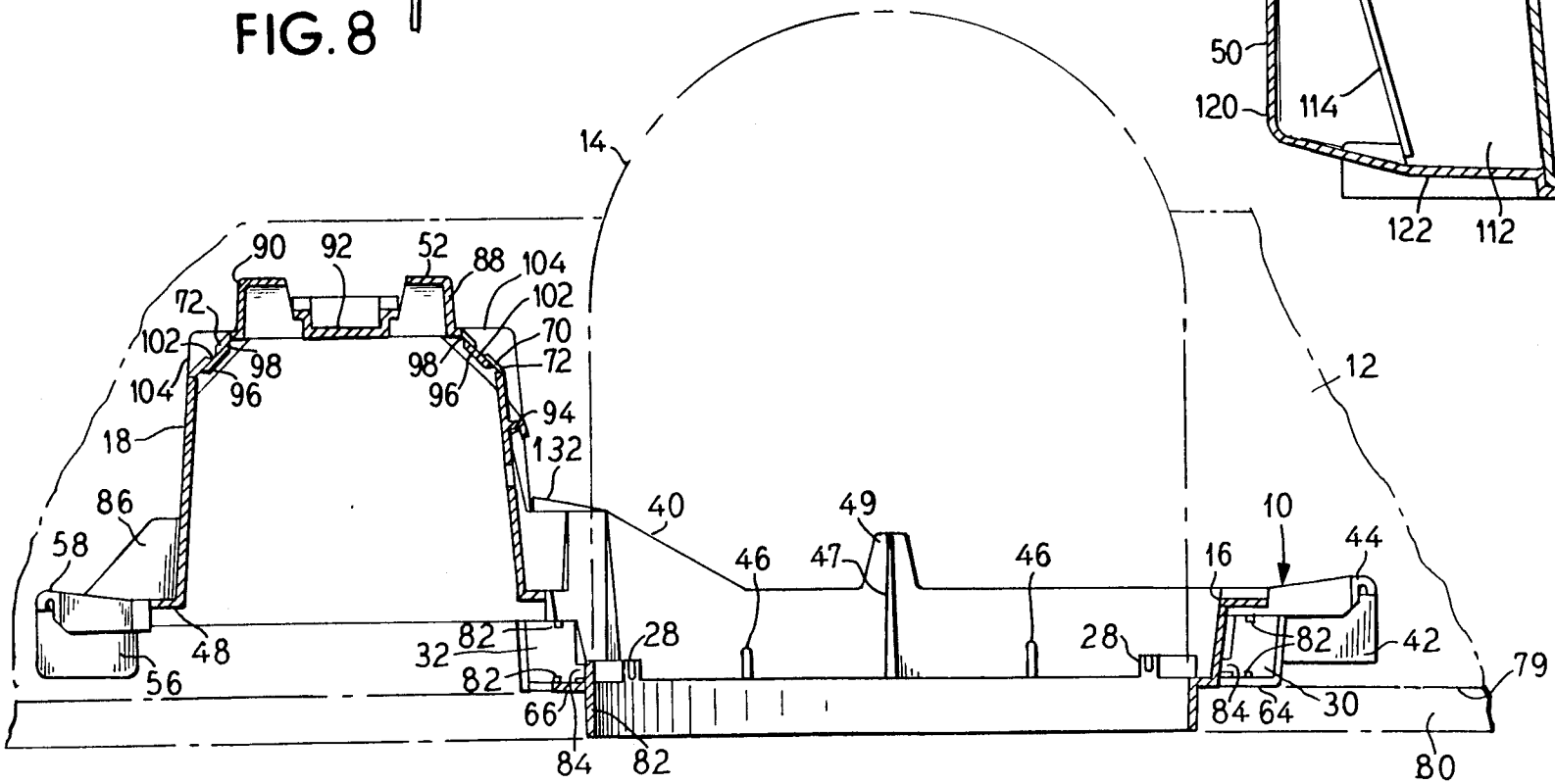
FIG. 4 is a cross section along line IV—IV of FIG. 2 of the recessed lighting fixture and showing the lamp housing and ceiling panel in phantom.

A cross-sectional view in FIG. 4 shows the recessed lighting fixture 10 mounted on the joist 12 with the alignment tabs 64 and 66 engaged at a lower edge 79 of the joist 12 to align the lighting fixture 10 in the ceiling. The ceiling in which the recessed lighting fixture 10 is mounted includes a ceiling panel 68 in which an opening is formed for the recessed lamp fixture. The frame 16 of the present fixture includes a lip 82 which extends through the opening in the ceiling panel 80.

Also visible in FIG. 4 are the hangerways 30 and 32 on either side of the frame 16 which define passageways through which hanger bars can be inserted. The illustrated hangerways 30 and 32 are adapted to receive two part hanger bars that telescope together with each part being inserted into the hangerways from opposite ends. Within the hangerways 30 and 32 are ridges 82, also shown in FIG. 2, which engage the hanger bars and prevent shifting of the fixture thereon. An edge 84 and a further edge (not shown) in another plane permit flat hanger bars to lie horizontally during insertion and/or during mounting.

The vertical support flange 38 extends across the rear of the frame 66 from the right nailway 44 to the junction box 18. The link portion 40 extends upwardly so that the junction box 18 lies spaced above the plane of the ceiling panel 68 and in a position so that the junction box 18 is accessible from through the opening 24, as described above. A continuation 86 of the vertical flange 40 at the opposite side of the junction box 18 connects the left nailway 58 to the fixture 10.

The junction box 18 in FIG. 4 is shown without the lid 50 so that only the portions of the hinge 52 on the stationary portion 48 are present. These include hinge ends 88 and 90 and a lower center part 92. The hinge portions of the door 50 cooperate with these parts to form the hinge 52. A hook 94 extends from the side of the junction box 18 for holding the connector means 59 in place on the side of the junction box 18.

The junction box 18 of the preferred embodiment includes the corner knock-outs 70, two on each side of the junction box 18. Each corner knock-out 70 has a rectangular plate 96 lying at approximately 45° to the side and top walls of the box and surrounded by a thin, frangible membrane 98. Across the top of the plate 96 is the ridge 72 which connects the plate 96 to the top and side walls. A notch 102 is formed in the ridge 72 into which a tool such as a screwdriver is pushed to break the frangible film 98 for removal of the knock-out 70. To prevent an adjacent knock-out 70 on an edge from being inadvertently removed when the other knock-out is being removed, a wall 104 is provided therebetween.

In FIG. 5, the junction box 18 is shown in cross section with the door 50 in the closed position. The hinge 52 includes not only the portions 90 and 92 on the stationary portion 48 but also pin portion 104 connected to the lid 50 by flanges 106. The hinge 52 permits the door 50 to swing between a closed position against stationary portion 48 as shown in FIG. 5 and an open position as shown in FIG. 1. The stationary portion 48 also includes a top wall 108 and a rear wall 110 as well as sidewalls 112. The sidewalls 112 end at an angular front edge 114, which preferably lies at 15° to vertical. A flange 116 on the rear wall 110 defines the planar abutting surface 62 of the junction box 18. The door 50 also includes side wall portions 118 as well as a front wall 120 and a bottom wall 122 which closes the bottom opening of the junction box 18. The corner knock-outs 70 can be seen from the inside with the frangible films 98 surrounding the plates 96.

Figure 6:
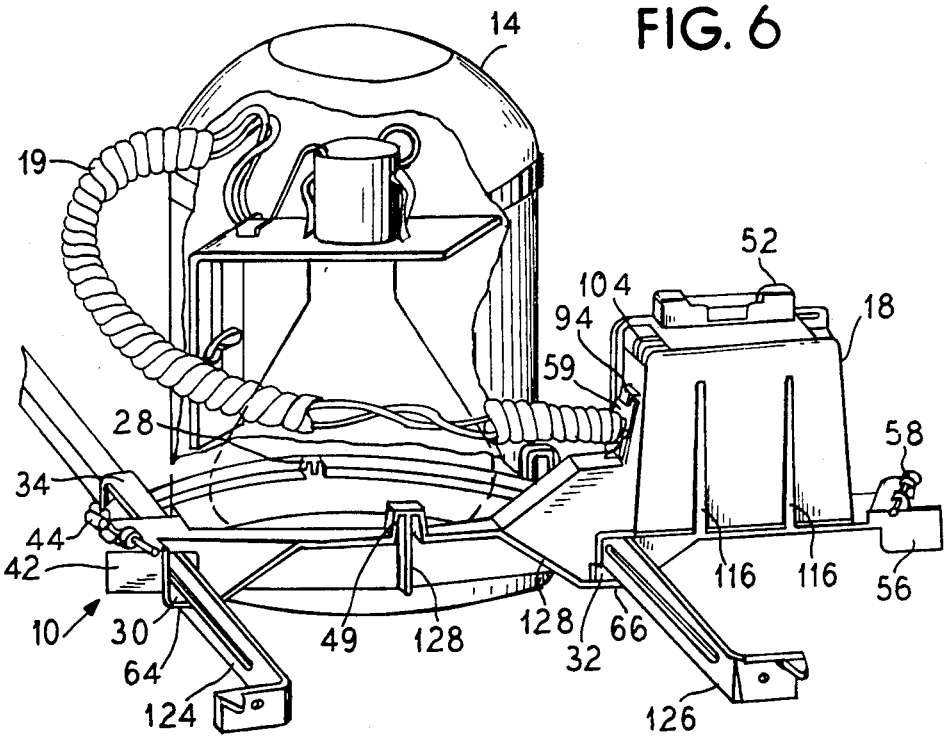
FIG. 6 is a perspective view of the present recessed lighting fixture being supported on hanger bars and holding a lamp housing.

FIG. 6 shows a rear view of the recessed lighting fixture 10 mounted on hanger bars 124 and 126 instead of being abutted against and fastened to a joist. The hanger bars 124 and 126 extend through the hangerways 30 and 32 and support the lighting fixture 10 and the lamp housing 14. On the rear wall of the support flange 38 can be seen supporting ribs 128 which define the planer abutting surface 60. Supporting ribs 116 are formed on the rear of the junction box 18 which also lie in the plane of the joist abutting surface 60. Details of the lamp housing are also shown including the bulb, socket, and wiring raceway 19 through which the electrical wiring for the bulb passes. The hook 94 holding the metal connector plate 59 to the junction box 18 can also be seen.

Figure 7:
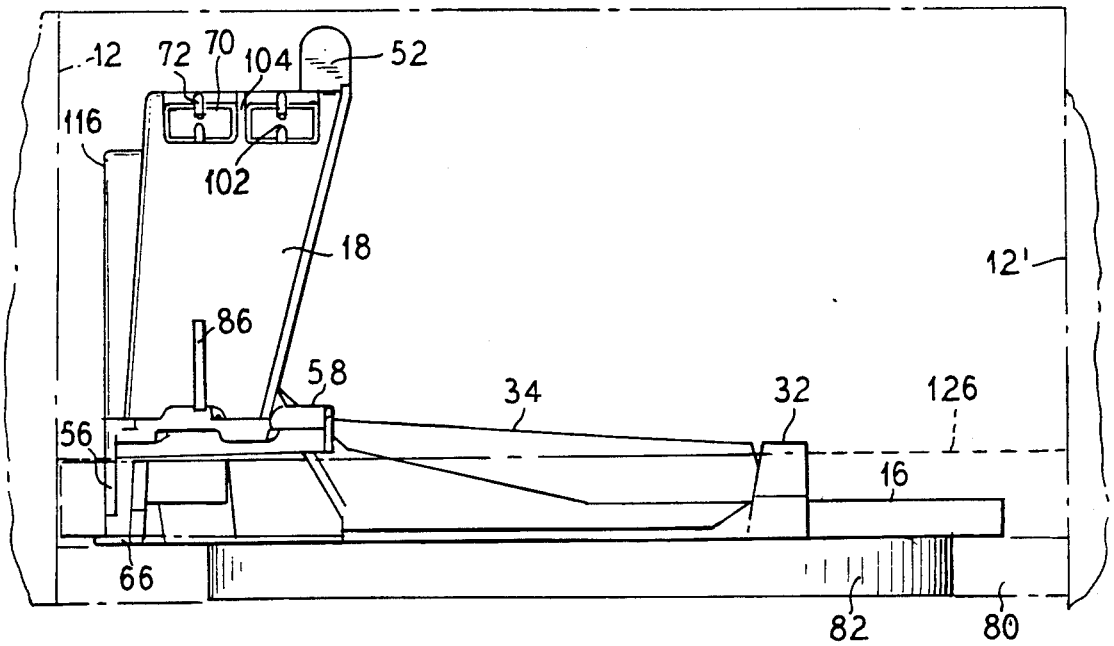
FIG. 7 is a side elevational view of the recessed lighting fixture shown mounted between joists using hanger bars.

In FIG. 7 is shown a side view of the present recessed lighting fixture 10 having the planer surface 60 spaced from the joist 12 yet supported between the joist 12 and a second joist 12' by the hanger bars 124 and 126. The present lighting fixture 10 is to be mounted on the hanger bars 124 and 126 when the lamp fixture 14 is to be mounted between joists 12 and 12' rather than adjacent a single joist 12. As can be seen in FIG. 7 and further in FIGS. 1 and 2, the hangerways 30 and 32 provide at least two support locations for resting on the hanger bars 124 and 126 so that the lighting fixtures 10 is supported evenly on the hanger bars within the ceiling.

The present lighting fixture as illustrated is molding in two pieces, the frame 16 and junction box 18 constituting the first piece and the door 50 constituting the second piece. It is also contemplated that by replacing the illustrated hinge with a living hinge of a flexible film the door can be molded in one piece with the frame. The fixture is formed of a polymeric material and is, therefore, lightweight and inexpensive. It is also possible that the fixture can be molded of a metal, such as zinc, or some other material.

Figure 8:
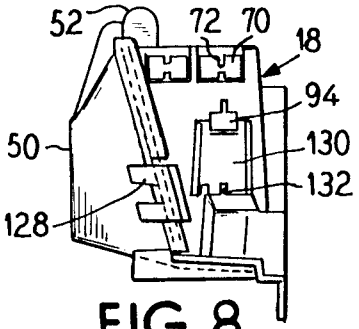
FIG. 8 is a side elevational view of the junction box of the present invention showing a conduit connection and ground plate in the side thereof.

In FIG. 8 is shown a side view of the junction box 18 from the direction of the frame 16. A latch 128 which secures the door 50 in a closed position is located in a position that is accessible by someone reaching upward through the opening in the ceiling 80 and through the opening 24 in the frame 16. This enables the junction box 18 to be opened after the fixture 10 has been installed.

Also visible in FIG. 8 is an opening 130 over which the connector plate 59 will be mounted. The hook 94 extends over the top of the opening 130 while a flange 132 is at the lower side of the opening 130 on the portion 40 extending nearly to the sidewall of the junction box 18. The flange 132 is spaced from the sidewall of the junction box 18 by approximately the thickness of the metal connector plate 59 as can be seen in FIG. 4. This enables the connector plate 59 to be slid into place over the opening 130.

FIG. 9 shows the connector plate 59, partially broken away to reveal a ground connector tab 134 that is formed when an opening 136 is punched in the plate 59. The opening 136 receives a spider clip 138 which fastens an end 140 of the conduit, or raceway, 19 to the plate 59. The tab 134 provides a convenient location for connecting the various ground leads of the lamp power supply, such as the ground lead 142. In the illustrated example, the ground lead 142 is connected to the tab 134 by a rivet 144, although other types of fasteners may, of course, be used.

Since the tab 134 prevents the plate 59 from being slid completely into or out of position over the opening 130, a notch 148 is cut in the lower edge of the plate 59. To install the plate 59 over the opening 130, the top edge thereof is moved up under the hook 94 and the plate 59 is pivoted downward. During the downward movement, the plate 59 is positioned so that the tab 134 extends through the opening 130 and so that the notch 148 clears the flange 132. The plate 59 is thereby able to move into place completely against the side of the junction box 18. Thereafter, the plate 59 is slid sideways so that the notch 148 is no longer in line with the flange 132, thus, securing the plate 59 in place.

In conclusion, the present fixture is easily nailed into place against a ceiling joist in alignment with the ceiling as a result of the tabs 64 and 66 engaging the lower edge of the joist and is then ready for installation of the lamp housing and wiring. Wiring is facilitated by the front and bottom opening junction box 18, which may be closed again easily by moving the hinged lid into the closed position and snapping the latch 128 closed. After installation, inspection and repair are made easier without requiring removal of the ceiling panel since the positioning of the junction box relative to the opening 24 in the frame 16 permits the latch to be opened and the contents of the box 18 to be seen through the opening. Not only is the molded, preferably plastic, fixture light weight and inexpensive, but it is also versatile since it can also be mounted by the traditional hanger bars. Embodiments which are only mountable by hanger bars are also contemplated.

The present device is preferably molded of Polyman 509, a tradename of a flame retardent mix of ABS and PVC by A.L. Schulman Company.

Although other modifications and changes may be suggested by those skilled in the art, it is the intention of the inventors to embody within the patent warranted hereon all changes and modifications as reasonably and properly come within the scope of their contribution to the art.

What is claimed is:

1. A support frame for holding a lamp housing of a recessed lighting fixture in a ceiling, comprising:

a molded recessed lighting frame member of a plastic material having an opening in which a lamp housing is mounted so that light from the lamp mounting is projected through said opening;

a molded junction box having at least one portion formed in one piece with said frame member, said at least one portion being of the plastic material; and means for affixing said molded recessed lighting frame member abutting a lateral face of a joist in the ceiling, said means for affixing being commonly molded with said molded lighting frame member.

2. A support frame as claimed in claim 1, wherein said junction box is positioned relative to said opening in said frame member such that said junction box is accessible from through said opening.

3. A recessed lighting fixture for holding a lamp housing in a ceiling supported by joists, comprising:

a molded plastic frame defining a lamp aperture lying in a first plane and adapted to hold a lamp housing in said lamp aperture, said molded plastic frame having a joist abutting surface lying in a second plane and adapted to directly abut a lateral surface of a joist, said first and second planes being generally perpendicular to one another;

nailways molded integrally with said molded plastic frame on either side of said lamp aperture, said nailways being directed into said second plane and adapted to receive nails and the like extending into a joist abutting said joist abutting surface.

4. A recessed lighting fixture as claimed in claim 3, further comprising:

hangerways extending through said frame on either side of said lamp aperture, said hangerways adapted to receive hanger bars for supporting said frame in a suspended position.

5. A recessed lighting fixture as claimed in claim 3, further comprising:

a junction box connected to said frame, said junction box including selectively openable openings for receiving electrical wiring, said junction box being comprised of a hinge connecting two relatively movable portions hinged together for selective opening and closing of said junction box.

6. A recessed lighting fixture as claimed in claim 5, wherein said junction box is positioned relative to said frame for free access from below when in a normal mounted position, a first of said two portions of said junction box being fixed relative to said frame and being open from below, a second of said two portions being a door hinged to close said first portion from below.

7. A recessed lighting fixture as claimed in claim 6, wherein said two parts of said junction box are hinged at a top of said junction box when mounted in a normal position.

8. A recessed lighting fixture for holding a lamp housing in a ceiling supported by joists, comprising:

a frame defining a lamp aperture lying in a first plane and adapted to hold a lamp housing in said lamp aperture, said frame having a joist abutting surface lying in a second plane and adapted to directly abut a lateral surface of a joist, said first and second planes being generally perpendicular to one another;

nailways on said frame on either side of said lamp aperture, said nailways being directed into said second plane and adapted to receive nails and the like extending into a joist abutting said second abutting surface;

hangerways extending through said frame on either side of said lamp aperture, said hangerways adapted to receive hanger bars for supporting said frame in a suspended position, said hangerways being shaped to accept hanger straps oriented either in a substantially horizontal plane or hanger straps oriented in a substantially vertical plane.

9. A recessed lighting fixture for holding a lamp housing above an aperture in a ceiling, comprising:

a housing mounting frame defining a frame aperture positionable above the aperture in the ceiling, said housing mounting frame lying generally in a first plane and adapted to accept a lamp housing;

a joist abutting flange connected to one side of said housing mounting frame, said joist abutting flange defining a joist abutting face lying in a plane generally perpendicular to said first plane of said housing mounting frame;

alignment tabs extending from said joist abutting flange and projecting beyond said joist abutting face, said alignment tabs lying in a plane generally parallel to said first plane of said housing mounting frame;

a first portion of a junction box connected to said joist abutting flange, said first portion being open at least at a bottom relative to a normal mounting position of said fixture; and a second portion of said junction box connected by a hinge to said first portion, said second portion substantially closing said first portion when in a closed position.

10. A recessed lighting fixture as claimed in claim 9, further comprising:

a first fastening retainer at a first end of said joist abutting flange;

a second fastening retainer at an end of said junction box opposite said first end of said joist abutting flange, said first and second fastening retainers including nailways forming passageways for nails and the like, said nailways being positioned so that nails extending therethrough are at mutually different angles for securing said joist abutting face to a surface.

11. A recessed lighting fixture as claimed in claim 9, further comprising:

first and second passageways extending through said housing mounting frame generally parallel to said first plane and adapted to accept hanger bars for supporting said fixture free of a joist.

12. A recessed lighting fixture as claimed in claim 11, wherein said first and second passageways are on either side of said frame aperture.

13. A recessed lighting fixture as claimed in claim 9, wherein said second portion of said junction box is hinged about an axis extending generally parallel to said first plane.

14. A recessed lighting fixture for holding a lamp holder in a ceiling opening, comprising:

a plaster frame formed of an open frame portion adapted to receive the lamp holder;

a ceiling joist engaging means integrally connected to said open frame portion, said ceiling joist engaging means defining an abutment surface for abutment against a side face of a ceiling joist;

aligning tabs extending beyond said planar surface at a lower edge of said plaster frame, said aligning tabs adapted for engaging a lower edge of the ceiling joist when said abutment surface is against the ceiling joist;

a junction box having a first portion integrally formed on said ceiling joist engaging means, said junction box including a door attached to said first portion by a hinge, said junction box being accessible from below when said door is hinged to an open position; and fastening means for affixing said recessed lighting fixture to the ceiling joist.

15. A recessed lighting fixture for holding a lamp housing above and in registration with an opening in a ceiling, ceiling joists being above said ceiling, comprising:

a frame of a plastic material, said frame including a lip projecting into the opening in the ceiling and fastener receiving means for receiving fasteners extending between said frame and the lamp housing to hold the lamp housing in said frame;

first and second hangerways extending through said frame on either side of said frame and adapted to receive hanger straps for supporting said frame;

a first portion of a junction box formed of said plastic material and molded in one piece with said frame, said first portion including knock-outs for selective removal to form openings for electrical wiring, said first portion having a bottom opening at a lower surface and a side opening at least one side surface;

a second portion of said junction box selectively fastenable over said bottom opening and said side opening of said junction box;

a hinge connecting said first and second portions of said junction box to one another;

a joist abutting surface on said frame, said joist abutting surface being oriented in a plane generally at a right angle to said frame and being at one side of said frame;

orienting tabs extending from said plane of said joist abutting surface and being in a plane substantially parallel to said frame; and nailways formed at either side of said frame, said nailways defining passageways directed into said plane of said joist abutting surface to accept nails and the like for fastening said fixture with said joist abutting surface abutting a joist.

16. A support frame for holding a lamp housing of a recessed lighting fixture, comprising:

a molded recessed lighting frame member of a plastic material having an opening in which a lamp housing is mounted so that light from the lamp mounting is projected through said opening;

a molded junction box having at least one portion formed in one piece with said frame member, said at least one portion being of the plastic material; and a metal ground plate fastened to said molded junction box and adapted for connection to electrical ground leads, said ground plate being fastened to an electrical raceway carrying wiring to the lamp housing.

17. A recessed lighting support frame for holding a lamp housing, comprising:

a molded recessed lighting frame member of a plastic material having an opening in which a lamp housing is mounted so that light from the lamp mounting is projected through said opening; and hangerways molded in one piece with said frame member and being disposed on either side of said opening, said hangerways adapted and constructed to receive hanger bars for supporting said frame member on said hanger bars.

18. A support frame for holding a lamp housing adjacent a joist or the like, comprising:

a molded frame member of a plastic material having an opening for receiving a lamp housing, said molded frame member lying predominantly in a first plane;

a joist abutting flange defining a generally planar surface in a plane generally perpendicular to said first plane, said joist abutting flange being molded in one piece with said frame member; and means molded integrally with at least one of said frame member and said joist abutting flange for guiding a fastener into said first plane for affixing said planar surface of said joist abutting flange against a joist or the like for supporting said frame.

19. A plaster frame for lighting fixture for attachment to a building joist comprising a substantially L-shaped frame member molded in a singe piece from a molded plastic material with one leg of the L defining an arcuate opening for receipt of a lamp housing therethrough and the other leg defining at least one planer surface at a right angle to the plane of the arcuate opening for abutment against a joist to align the plane of the opening normal to a side of the joist, a junction box commonly molded as a part of said frame affixed to the said other leg and means for affixing fasteners for joining said frame to said joist, said means molded to said frame.

* * * * *

UNITED STATES PATENT AND TRADEMARK OFFICE

CERTIFICATE OF CORRECTION

PATENT NO. : 5,057,979

DATED : October 15, 1991

INVENTOR(S) : Douglas W. Carson and Raymond J. Kusmer

It is certified that error appears in the above—identified patent and that said Letters Patent is hereby corrected as shown below:

ON TITLE PAGE: Item [75] correct the spelling of the second inventor to read --Raymond J. Kusmer--.

Signed and Sealed this

Second Day of March, 1993

*Attest:*

STEPHEN G. KUNIN

*Attesting Officer*

*Acting Commissioner of Patents and Trademarks*